US005469706A

United States Patent [19]

Hoya

[11] Patent Number: 5,469,706

[45] Date of Patent: Nov. 28, 1995

[54] LIQUID FUEL ATOMIZING UNIT FOR MINIATURE JET ENGINE

[75] Inventor: Hiroshi Hoya, Tokyo, Japan

[73] Assignee: Sophia Precision Corp., Tokyo, Japan

[21] Appl. No.: 338,192

[22] Filed: Nov. 9, 1994

[30] Foreign Application Priority Data

Nov. 10, 1993 [JP] Japan ..... 5-281189

[51] Int. Cl.[6] ..... F02C 7/22

[52] U.S. Cl. ..... 60/739; 60/740; 239/488

[58] Field of Search ..... 60/734, 739, 740, 60/257, 258, 259; 239/488

[56] References Cited

U.S. PATENT DOCUMENTS

| | | | |
|---|---|---|---|
| 1,688,585 | 10/1928 | Lalor | 239/488 |
| 2,626,187 | 1/1953 | Toftmann | 239/488 |
| 2,676,461 | 4/1954 | Gove | 60/739 |
| 5,115,638 | 5/1992 | Reed et al. | 60/39.281 |

FOREIGN PATENT DOCUMENTS

| | | | |
|---|---|---|---|
| 2636093 | 3/1990 | France . | |
| 205277 | 10/1923 | United Kingdom | 239/488 |

*Primary Examiner*—Louis J. Casaregola
*Attorney, Agent, or Firm*—Armstrong, Westerman, Hattori, McLeland and Naughton

[57] ABSTRACT

A structure having radial holes extending from a ring passage communicated with a revolution lead fittings having spiral grooves and fuel lead fittings having truncated cone shaped holes and straight holes, and further provided with an outer fixing ring having spray holes and hemispherical recesses.

3 Claims, 5 Drawing Sheets

LIQUID FUEL ATOMIZING UNIT FOR MINIATURE JET ENGINE

FIELD OF THE INVENTION

The present invention relates to a miniature jet engine for use in model airplanes, teaching materials and the like, and has the same concepts as full scale jet engine in operational principle and structure.

DESCRIPTION OF THE PRIOR ART

One attempt for a miniature jet engine has been already disclosed in a reference, for example, in French Patent No. 8811766. A conventional miniature jet engine, with reference to FIGS. 4 and 5, hereof and designated by the reference numeral E1 has, in order from a forward end thereof, air intake portion 1, compressor portion 3, combustion portion 8, turbine portion 21 and jet nozzle portion 23. The air intake portion 1 is formed by a truncated cone portion 2 having shortened diameter gradually toward the rearward sections thereof.

The compressor portion 3 includes, in a casing 4 thereof, a radial compressor 5, rotated by a following radial-flow turbine 22 associated with a turbine shaft 15, and a guide ring 7 forming an air passage 6 in combination with the casing 4. The guide ring 7 is mounted on the casing 4 by eight sets of mounting portions 7*a* and bolts 70 in a manner so that each set is disposed on the same circle at predetermined intervals.

The combustion portion 8 includes, in a casing 9, an outer combustion liner 11, forming a double cylindrical air passage 10, in combination with the casing 9, and an inner combustion liner 14 forming a double cylindrical primary combustion chamber 12 and secondary combustion chamber 13 in combination with the outer combustion liner 11. In the inner combustion liner 14, a turbine shaft 15 is supported to rotate at high speed by front and rear bearings 17*a* and 17*b* in a bearing case 16A, fixed to the guide ring 7 by, for example, three bolts 71. An aperture, between the guide ring 7 and the turbine shaft 15, is sealed by an oil seal 72. The outer combustion liner 11 is provided with plural air conduits 19 to lead air flown through the air passage 10 into the primary and secondary combustion chambers 12 and 13 and plural air vents (not shown). The secondary combustion chamber 13 has, therein, a guide vane 20. It should be understood that the reference numeral 18, in the drawing, is a coil spring adapted to constantly preload the rear bearing 17*b*.

The turbine portion 21 receives therein the radial-flow turbine 22, driven by a combustion gas in the secondary combustion chamber 13 in a state that the rotation of the turbine 22 is transmitted to the radial compressor 5 via the turbine shaft 15.

The nozzle portion 23 is defined by a front cone 24, having enlarged diameter gradually in the rearward sections thereof and a rear cone 25 which has shortened diameter gradually in the rearward sections thereof and is adapted to be coupled with the front cone 24. The coupling portion, between the cones 24 and 25, is a ring-shaped fuel heating portion 26.

There is further provided, a fuel tank 27 for storing liquid propane supplied into a fuel control needle valve 30 via a shut-off valve 28, fuel tubes 29*a* and 29*b*, fuel heating portion 26 and fuel tube 29*c*. The fuel control needle valve 30 is connected to a fuel feed pipe 31 and, further, to a ring passage 31*a* arranged in the bearing case 16A, from where it is connected to plural fuel injection holes 32 opened at a forward portion in the inner combustion liner 14 of the primary combustion chamber 12. Each of the fuel injection holes 32 is of a straight hole extending radially from the ring passage 31*a* at equal space intervals.

The above conventional unit is operated as described in the discussion which follows. Fresh air, taken through the air intake portion 1, is compressed by the radial compressor 5 and fed into the primary combustion chamber 12 via the air passage 10.

When the shut-off valve 28 is opened, liquid propane, stored in the fuel tank 27, is transmitted, via the fuel tubes 29*a* and 29*b*, due to the vapor pressure thereof and vaporized in the fuel heating portion 26, such vaporized propane as is sprayed into the primary combustion chamber 12 from the fuel injection holes 32 via the fuel tube 29*c*, the fuel control needle valve 30, the fuel feed pipe 31 and the ring passage 31*a*.

In the primary combustion chamber 12, the propane gas is mixed with air, for burning, and the combustion is further promoted in the secondary combustion chamber 13 to become a high-temperature and high-pressure gas to drive the radial-flow turbine 22 and rotate the radial compressor 5. The surplus gas, not consumed for driving the turbine 22, generates a propulsive force by jetting out rearward from the nozzle portion 23.

As has been explained above, because the conventional miniature jet engine E1 employs liquid propane as fuel thereof, it is not perfect in view of operational safety.

It has been therefore proposed to use any liquid fuel, such as JP-4 jet fuel which is actually employed in a jet engine of a full scale aircraft. However, it is known that combustion of such JP-4 liquid fuel, mixed with air in such small primary and secondary combustion chambers 12 and 13 in the general miniature jet engine, such as E1, is extremely difficult.

SUMMARY OF THE INVENTION

Accordingly, an object of the present invention is to provide a liquid fuel atomizing unit for miniature jet engines, which is capable of conducting preferable combustion of liquid fuel in a small combustion chamber.

In accordance with the present invention, the liquid fuel atomizing unit has a ring-shaped liquid fuel feeding passage; plural radial holes extending radially from such liquid fuel feeding passage at equal space intervals; a revolution lead fitting coupled into such each radial hole and provided with a spiral groove; a fuel lead fitting defined by a truncated cone shaped hole and a straight hole extending successively from the cone shaped hole in a state coupled into each radial hole and communicating with the revolution lead fitting; and an outer fixing ring, attached to the said fuel lead fittings, and defined by spray holes each successive to the straight holes and hemispherical recesses extending successively from the spray holes.

In the above mentioned liquid fuel atomizing unit for miniature jet engines, the fed fuel flows along the spiral grooves of the revolution lead fittings, to swirl therein, from where it will be further curling up in the cone shaped hole of the fuel lead fittings. The fuel is compressed in the straight hole and the spray hole of the outer fixing ring gradually and thereafter rapidly diffused in the hemispherical recess to be sprayed into the combustion chamber in a state of cone-shaped spray. This contributes to a preferable combustion of the mixture gas with enough air in the combustion chamber.

BRIEF DESCRIPTION OF THE DRAWINGS

The preferred embodiment of the present invention will now be described with reference to the drawings, in which.

In such description of the following embodiment, the same reference numerals will be used to designate the same, or similar, components as those in the prior art of FIGS. 4 and 5, so that the description will be omitted or simplified.

DETAILED DESCRIPTION OF THE PREFERRED EMBODIMENTS

Figure 1:
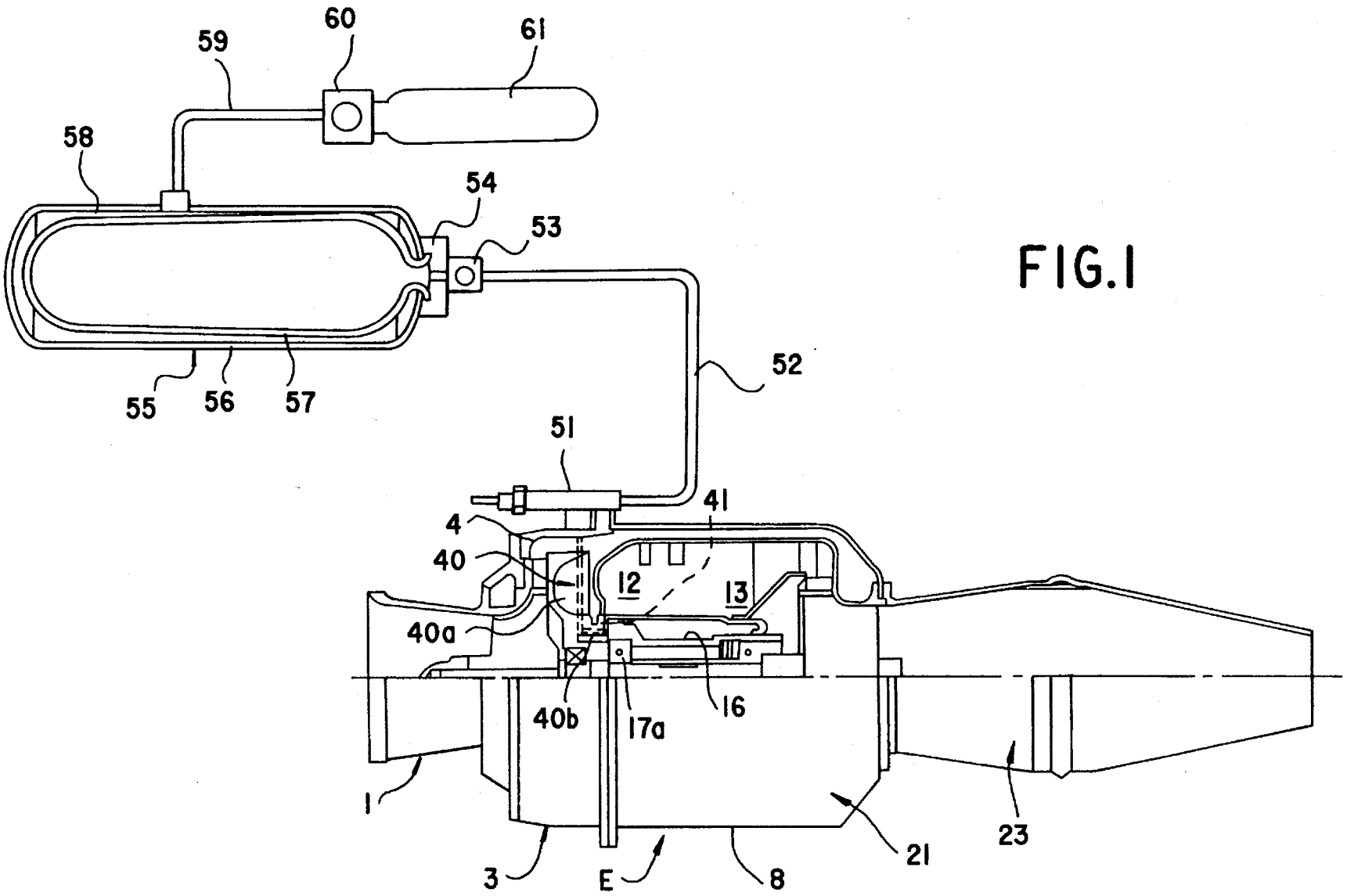
FIG. 1 is a side elevational view depicting a fragmental section of a miniature jet engine in a preferable embodiment in accordance with the present invention.
Figure 2:
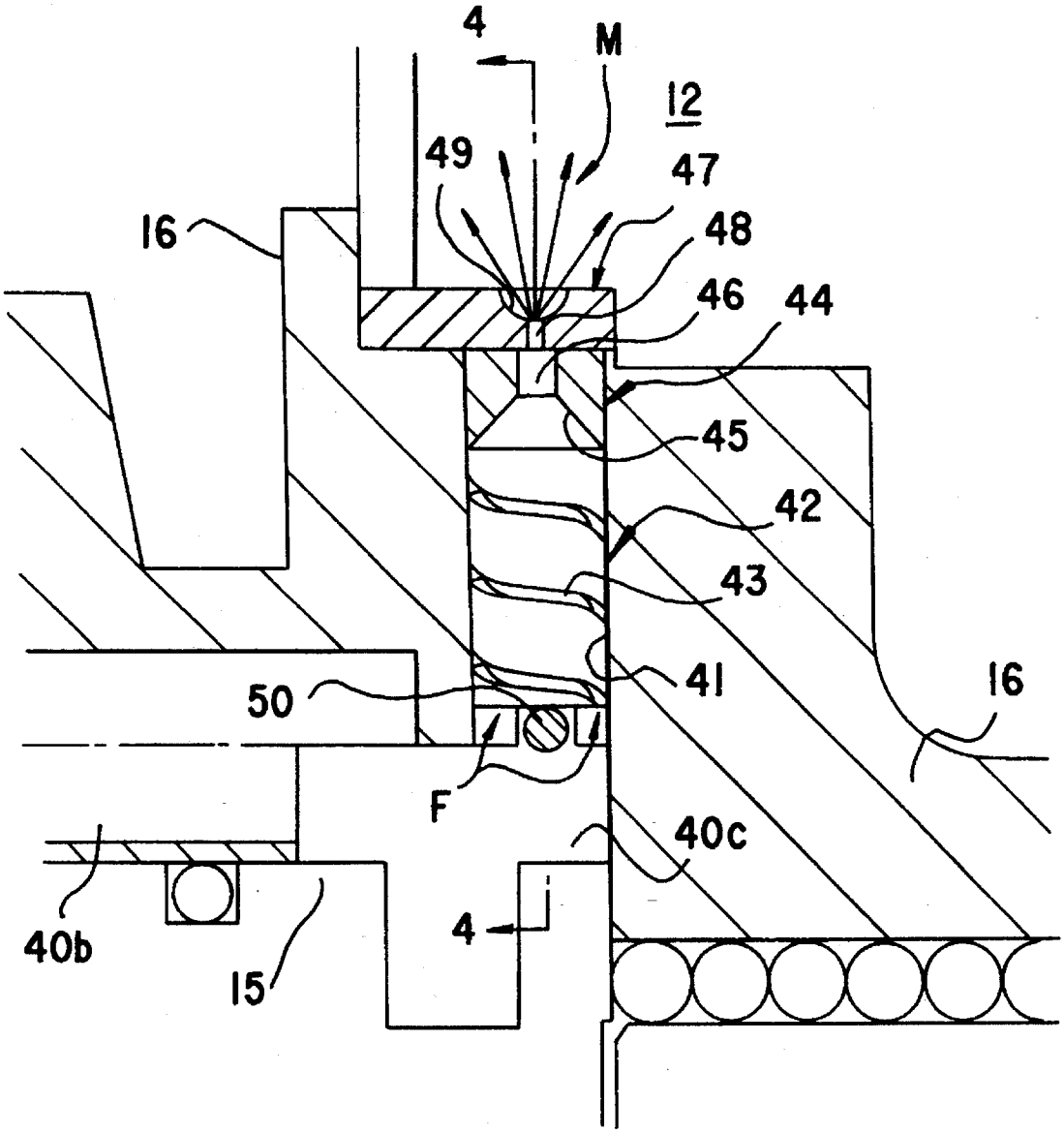
FIG. 2 is a fragmentary enlarged sectional view of a portion of the embodiment in FIG. 1.
Figure 3:
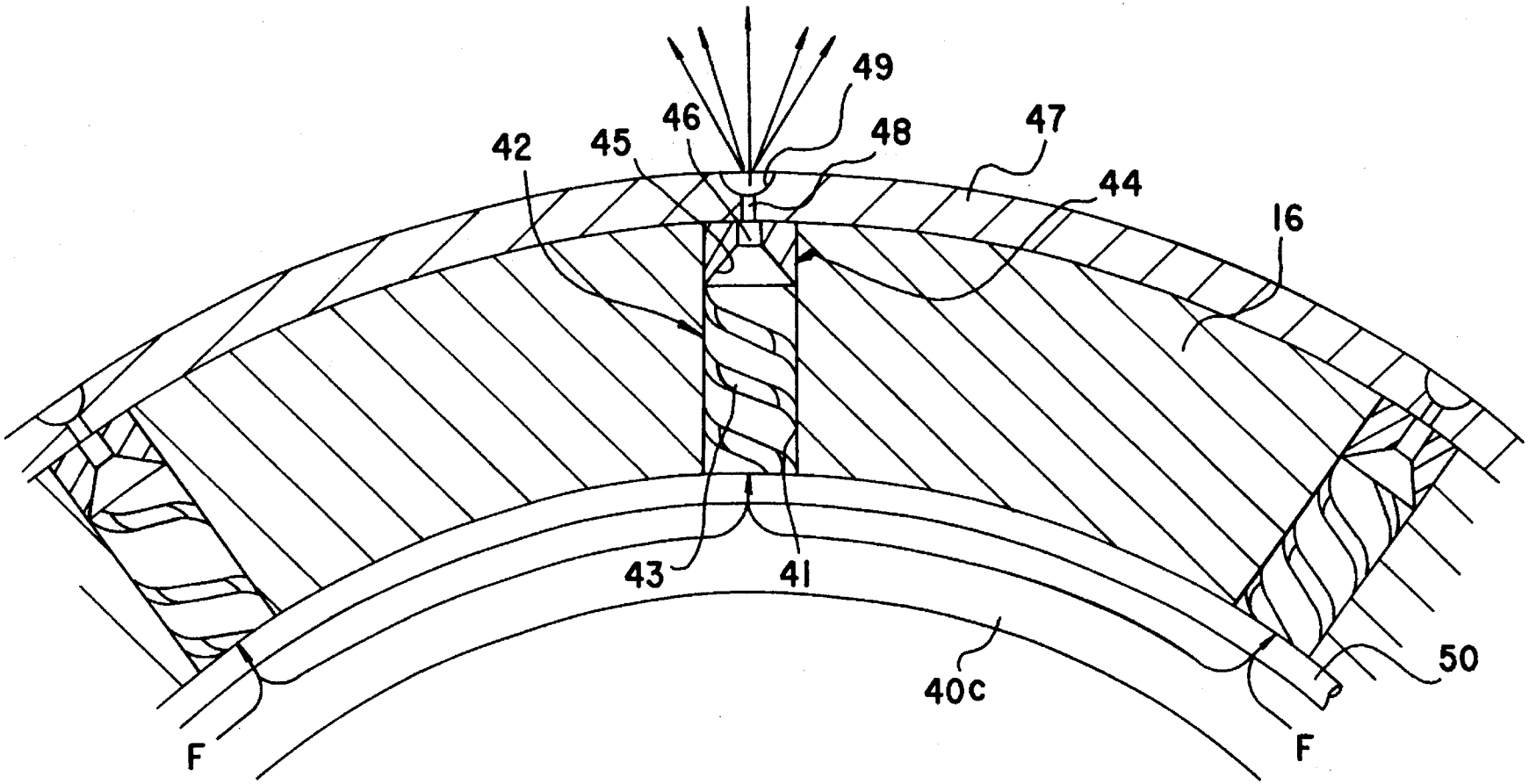
FIG. 3 is a sectional view taken along the A—A line in FIG. 2.
Figure 4:
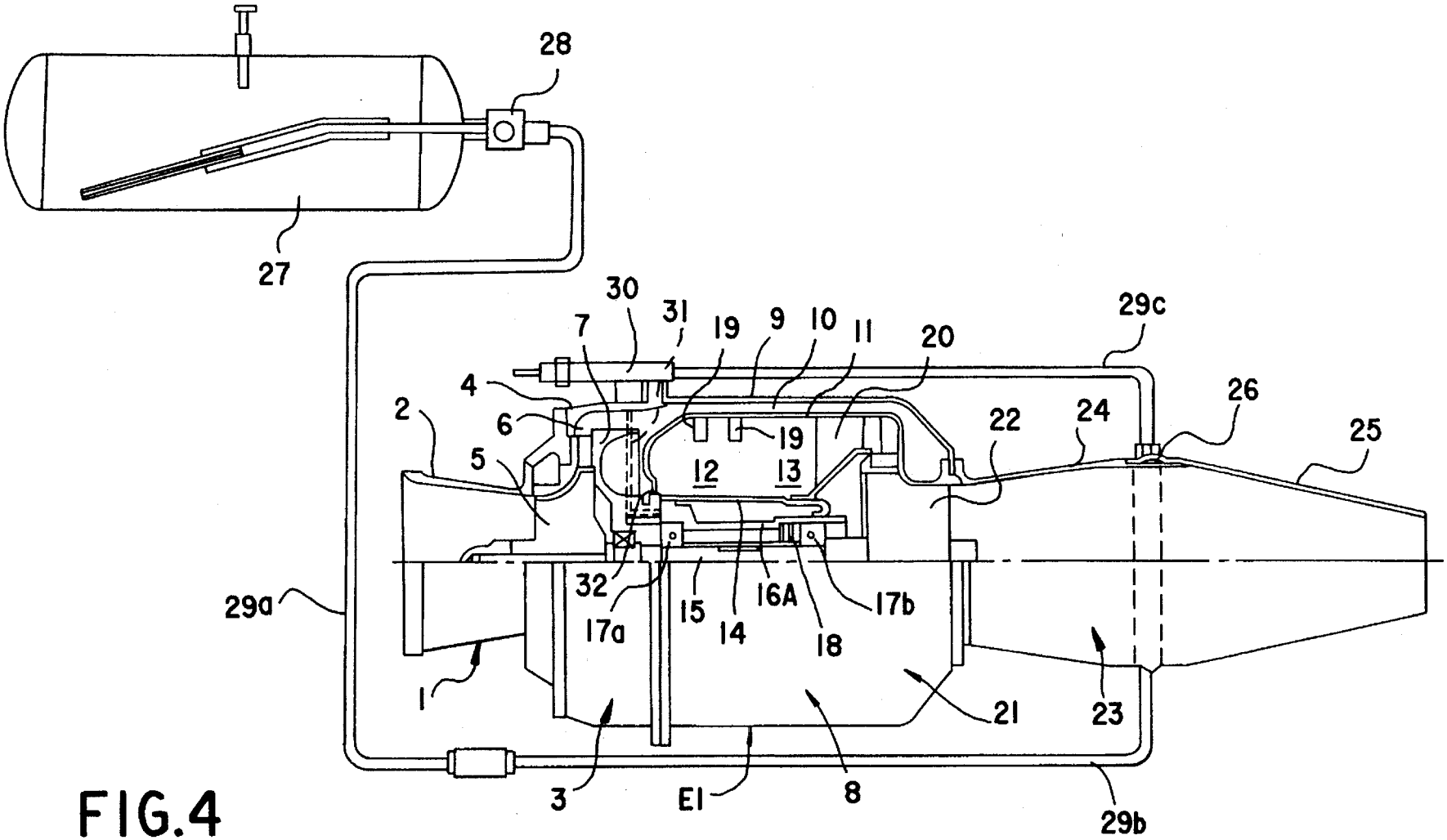
FIG.4 PRIOR ART
FIG. 4 is a side elevational view of a prior art conventional miniature jet engine as correspond to the view of the embodiment of the present invention shown in FIG. 1.
Figure 5:
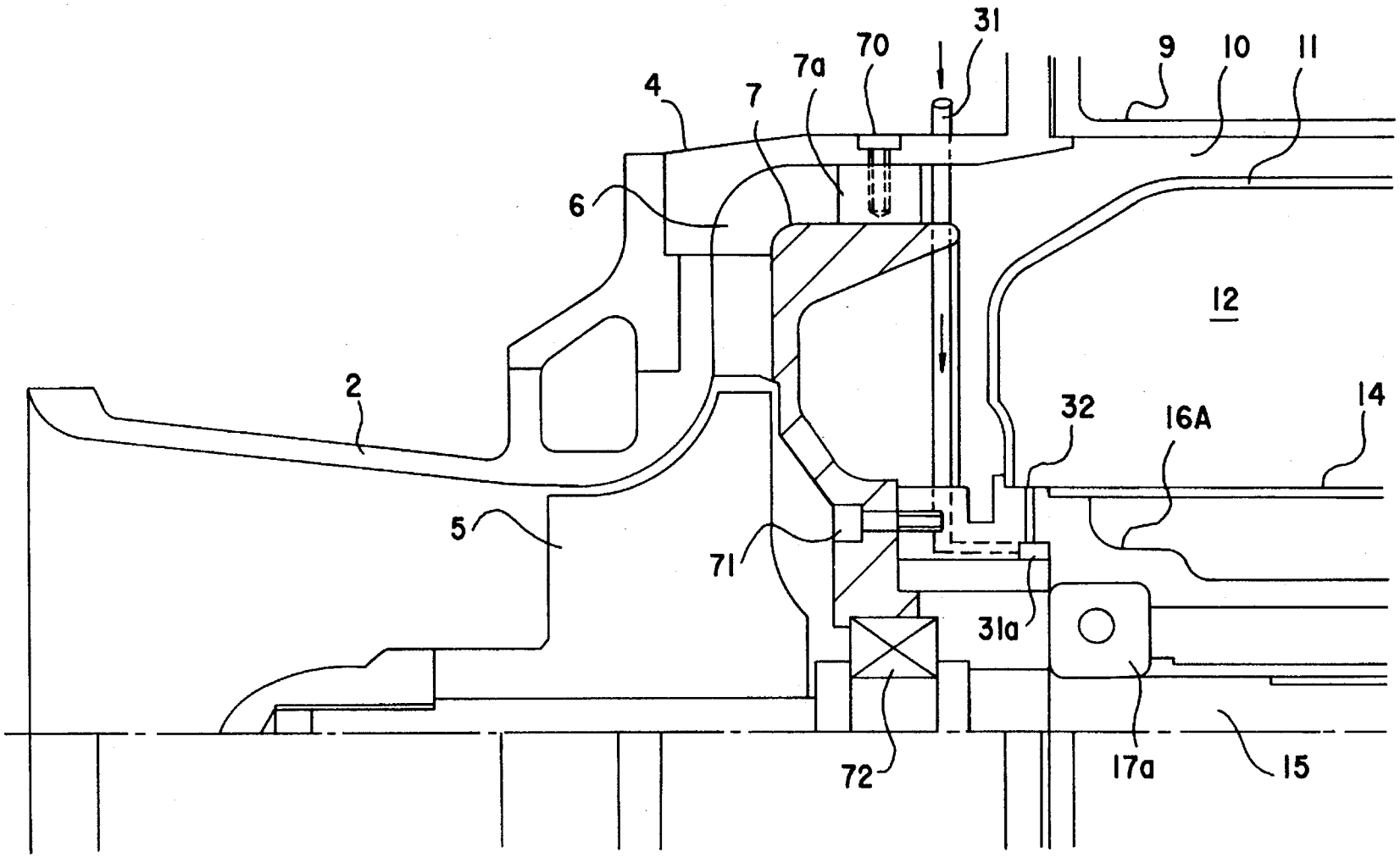
FIG.5 PRIOR ART
FIG. 5 is an enlarged sectional view of a portion of the prior art engine shown in FIG. 4.

As shown in FIGS. 1–3, a bearing case 16 of a miniature jet engine E, according to the present invention, relates to a radial passage 40*a* and an axial passage 40*b* extending toward a bearing 17*a* and a ring passage 40*c* (see FIG. 2) successive to the axial passage 40*b* so as to communicate with a fuel feed pipe 40, FIG. 1.

There are provided plural (e.g. 10) radial holes 41, extending radially from the ring passage 40*c*, FIG. 2, at equal space intervals. Each of the radial holes 41 is adapted to receive therein a revolution lead fitting 42 and a fuel lead fitting 44 which are all positioned by a combination of an outer fixing ring 47 on the bearing case 16 toward a primary combustion chamber 12 and an inner fixing ring 50, FIG. 2.

The revolution lead fitting 42 is provided with a spiral groove 43 on its peripheral portion.

The fuel lead fitting 44 is defined by a truncated cone shaped hole 45 and a straight hole 46 extending successively from the cone shaped hole 45.

The said outer fixing ring 47 is defined by spray holes 48 successive to the straight holes 46 and hemispherical recesses 49 extending successively from the spray hole 48.

As can be seen from the drawing, a fuel control needle valve 51 relates to an outlet of shut-off valve 53 via a liquid fuel tube 52. In an inlet of the shut-off valve 53 via a sleeve retainer 54 is inserted and secured to a fuel tank designated generally by the reference numeral 55.

A tank body 56 of the fuel tank 55 includes therein a so-called bladder 57 as a bag made of flexible materials, such as, rubber materials or resin materials. The tank body 56 and the bladder 57 are positioned by the sleeve retainer 54 so that an internal space of the bladder 57 is adapted to communicate with the liquid fuel tube 52. The bladder 57 is filled up with a liquid fuel F, such as, the jet fuel JP-4. Between the tank body 56 and the bladder 57 is provided a hollow portion 58 which is connected via a communication pipe 59 and a pressure regulator 60, to a nitrogen gas cartridge 61 which keeps therein an inert gas and is detachably attached to the pressure regulator 60.

The above unit in this embodiment facilitates an operative sequence as will be explained below.

After setting the nitrogen gas cartridge in the pressure regulator, the shut-off valve 53 is opened at the beginning of the operation. The nitrogen gas is fed into the hollow portion 58 to contract the bladder 57 so that the liquid fuel F is fed into the radial passage 40*a* via the tube 52 and the needle valve 51. The thus fed fuel F passes through the ring passage 40*c* and flows along the each spiral groove 43 to swirl therein, from where it will be further swirled in the each cone shaped hole 45. The fuel is compressed in the each straight hole 46 and the each spray hole 48 each gradually, and thereafter rapidly, diffused in the hemispherical recess 49 to be sprayed into the primary combustion chamber 12 in state of a cone-shaped spray M. This contributes to a preferable combustion of the mixture gas, with enough air, mainly flown along the axis in the primary combustion chamber 12.

As has been explained above, the structure employing the concept of the present invention can achieve a preferable combustion state even in a small combustion chamber for the miniature jet engine.

While the instant invention has been shown and described with specific reference to embodiments presently contemplated as the best mode of carrying out the invention in actual practice, it is to be understood that various changes may be made in adapting the invention to different embodiments without departing from the broader inventive concepts disclosed herein and comprehend by the claims which follow.

What is claimed:

1. A liquid fuel atomizing unit for a miniature jet engine, comprising: a ring-shaped liquid fuel feeding passage; plural holes extending radially from said liquid fuel feeding passage at equal spaced intervals; each of said radial holes having a revolution lead fitting extending radially from each said radial hole and provided with a spiral groove; a fuel lead fitting having a truncated cone shaped hole extending radially outward from each said fitting with the enlarged base of said cone shaped hole in contact with the outer radial end of said lead fitting and a straight hole extending radially outwardly from the truncated end of each of said cone shaped holes and a ring shaped outer fixing ring abutting the outer ends of said fuel lead fittings, said ring shaped outer fixing ring having a plurality of equally space radially extending spray holes in axial alignment with said straight holes in said fuel lead fitting, each of said radial extending holes in said ring shaped outer fixing ring having a hemispherical recess extending axially from said radial extending holes for atomizing fuel discharged through said fuel lead fittings into said spray holes in said outer fixing ring.

2. A liquid fuel atomizing unit, as recited in claim 1, further comprising a flexible liquid fuel bladder connected to a liquid fuel inlet end of said liquid fuel feed passage, a tank body around said bladder and a pressurized gas cartridge connected to said tank body.

3. A liquid fuel atomizing unit, as recited in claim 1, in which said ring-shaped liquid fuel feeding passage and said ring shaped outer fixing ring are mounted in a bearing case of said miniature jet engine with said spray holes in said outer fixing ring for discharging said fuel from said spray holes into combustion chambers of said miniature jet engine.

* * * * *